US011865470B1

(12) United States Patent
Lao et al.

(10) Patent No.: US 11,865,470 B1
(45) Date of Patent: Jan. 9, 2024

(54) TOY PLAYSET WITH MULTI-COMPARTMENT HOUSING

(71) Applicant: Mattel, Inc., El Segundo, CA (US)

(72) Inventors: Annalise Lao, Redondo Beach, CA (US); Alena Niu, Culver City, CA (US); Brian Hong, Valencia, CA (US); Kelley Lindberg, Los Angeles, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 18/189,375

(22) Filed: Mar. 24, 2023

(51) Int. Cl.
*A63H 3/52* (2022.01)

(52) U.S. Cl.
CPC ..... *A63H 3/52* (2013.01)

(58) Field of Classification Search
CPC .... A63F 9/00; A63F 9/001; A63F 2009/0012; G09B 1/00; G07F 17/3295
USPC ..... 446/71, 72, 73, 268, 308
See application file for complete search history.

(56) References Cited

U.S. PATENT DOCUMENTS 2,623,303 A * 12/1952 Mindel ..... G09B 1/10 434/259
3,496,652 A * 2/1970 Conte ..... A63F 9/12 273/156
3,650,064 A 3/1972 Fusco
4,108,431 A * 8/1978 Camara ..... A63F 9/0406 273/459
4,237,650 A * 12/1980 Goldfarb ..... A63F 9/00 446/141
4,457,722 A * 7/1984 Housand ..... G09B 19/24 434/260
4,522,598 A * 6/1985 Coyne ..... G09B 19/00 434/259
4,846,691 A * 7/1989 Acosta ..... A63F 9/00 434/259
4,911,670 A * 3/1990 McNicholas ..... A63H 3/52 446/487
5,120,262 A * 6/1992 Caine ..... A63H 3/52 446/476
6,599,131 B2 * 7/2003 Wolfson ..... G09B 19/00 434/428
6,880,754 B1 * 4/2005 Lie-Nielsen ..... A47G 29/10 235/383
8,297,800 B1 * 10/2012 Little ..... A63H 5/00 362/311.06
10,188,937 B1 * 1/2019 Whitney ..... A63F 9/0819
10,688,406 B2 * 6/2020 Menow ..... A63H 37/00
11,130,048 B2 * 9/2021 Singh ..... A63F 9/0811
(Continued)

FOREIGN PATENT DOCUMENTS

AU 2021106082 A4 10/2021
WO 2020234671 A1 11/2020

*Primary Examiner* — Joseph B Baldori
(74) *Attorney, Agent, or Firm* — Edell, Shapiro & Finnan, LLC

(57) ABSTRACT

A toy playset comprising a multi-compartment housing and a toy contained within the multi-compartment housing. The multi-compartment housing has a main compartment, a first locked compartment, and a second locked compartment. The main compartment contains the toy and a first key that is assigned to unlock the first locked compartment. The first locked compartment contains a second key that is assigned to unlock the second locked compartment.

20 Claims, 7 Drawing Sheets

(56) References Cited

U.S. PATENT DOCUMENTS

| | | | | |
|---|---|---|---|---|
| 2004/0253567 | A1* | 12/2004 | Kaye | G09B 5/062 434/178 |
| 2007/0015437 | A1 | 1/2007 | Laurienzo | |
| 2008/0096458 | A1 | 4/2008 | Andersen | |
| 2012/0100518 | A1* | 4/2012 | Yang | G09B 5/00 434/307 R |
| 2014/0094084 | A1* | 4/2014 | Lambrakis | A63H 3/365 446/99 |
| 2021/0228994 | A1 | 7/2021 | O'brien et al. | |

* cited by examiner

TOY PLAYSET WITH MULTI-COMPARTMENT HOUSING

FIELD OF THE INVENTION

The present invention relates generally to toys and, in particular, to toy playsets with multiple compartments that can be opened to reveal different items and accessories.

BACKGROUND OF THE INVENTION

Toys that incorporate elements of surprise or mystery are popular with children of all ages. These include mystery capsules, surprise eggs, blind bags or boxes, and other surprise toys where the contents are a mystery until they are opened or unwrapped. In an effort to increase the play value of these surprise toys, various packaging designs and surprise features have been introduced over the years. Nevertheless, because children will always be excited with toys that incorporate surprises and mysteries, there is still a need for ever more interesting and varied surprise toys that can delight and entertain a child.

SUMMARY OF THE INVENTION

A toy playset is presented herein with multiple compartments that can be opened to reveal different items and accessories. In a more specific embodiment, the toy playset contains multiple compartments that can be successively opened to reveal a toy figurine and its related accessories.

Generally, the toy playset comprises a multi-compartment housing with a main compartment and two or more lockable compartments. Contained in the main compartment and the lockable compartments are one or more toys and/or accessories. Also included in the multi-compartment housing are two or more keys, wherein each key is assigned to unlock one of the lockable compartments. The main compartment contains one of the keys and each of the lockable compartments contains one or none of the keys. The distribution of keys among the different compartments of the toy playset results in the opening of the compartments in a specific sequential order.

In one or more embodiments, each key has an identification feature that indicates the corresponding lockable compartment to be unlocked. For instance, each lockable compartment may be identified by a different color, symbol, shape, number, imagery, texture, and/or letter, and the identification feature is a matching color, symbol, shape, number, imagery, texture, and/or letter. In further embodiments, each key also includes a removable outer layer, such as a layer of water-dissolvable paint, that obscures the identification feature. Thus, when the removable outer layer is disposed on the key, a user is unable to determine which compartment the key is assigned to unlock. Only by removing the outer layer on the key will the user then be able to identify the corresponding compartment that is to be unlocked with the key.

In one or more embodiments, the main compartment contains a toy and at least one of the lockable compartments includes an accessory that can be attached to the toy. In certain embodiments, the toy is a figurine and the accessory is a hair accessory, clothing article, jewelry, or footwear that is configured to be worn by the figurine. The accessory may be further packaged in obscured packaging to provide another element of surprise to the toy playset.

Other objects, features and advantages of the present invention will become apparent to those skilled in the art from the following drawings and detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIGS. 1A and 1B are front views of the toy playset with its main compartment closed (FIG. 1A) and opened (FIG. 1B). FIG. 1C is a close-up view of a key taken from the main compartment;

FIG. 2A shows the key before the removal of its water-dissolvable outer layer. FIG. 2B shows the key after the removal of its water-dissolvable outer layer;

FIGS. 3A and 3B are close-up side perspective views of the compartment locked (FIG. 3A) and unlocked (FIG. 3B). FIG. 3C shows the accessories contained in the locked compartment, as well as a second key with its water-dissolvable outer layer removed;

FIGS. 4A and 4B are close-up side perspective views of the second locked compartment locked (FIG. 4A) and unlocked (FIG. 4B). FIG. 4C shows the accessories contained in the second locked compartment, as well as a third key with its water-dissolvable outer layer removed;

FIGS. 5A and 5B are close-up front views of the third locked compartment locked (FIG. 5A) and unlocked (FIG. 5B).

FIG. 5C shows the accessories contained in the third locked compartment, as well as a fourth key with its water-dissolvable outer layer removed;

FIGS. 6A and 6B are close-up side perspective views of the fourth locked compartment locked (FIG. 6A) and unlocked (FIG. 6B). FIG. 6C shows the accessories contained in the fourth locked compartment.

DETAILED DESCRIPTION OF THE INVENTION

Figure 1A:
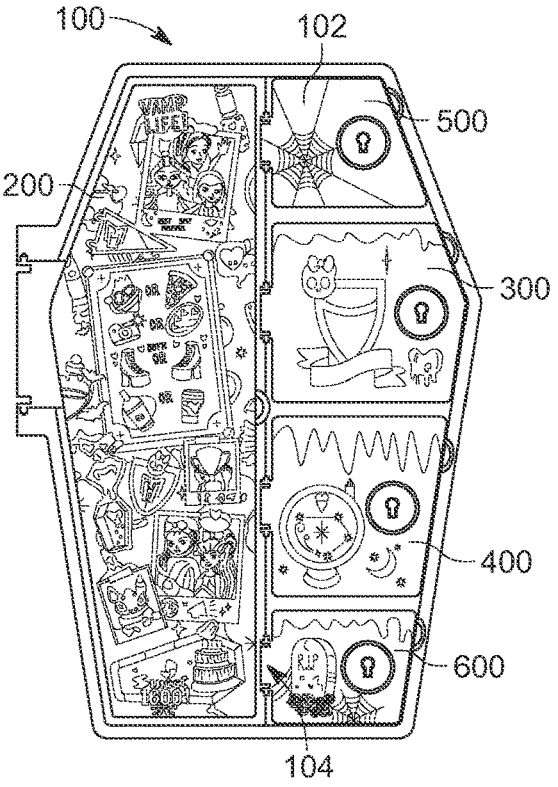
FIGS. 1A-1C show a toy playset, in accordance with an illustrative embodiment of the invention.

A toy playset is disclosed comprising a housing with multiple lockable compartments that contain various toys and accessories. Each compartment contains a key that allows a user (e.g., a child) to unlock one of the other compartments. By successively opening the compartments with each key, the user is able to progressively access all the toys and accessories contained within the toy playset. Thus, the toy playset provides a prolonged initial unboxing experience filled with multiple surprise reveals, as well as a fun system of play that can be repeated when the keys are placed back into the compartments of the toy playset.

FIGS. 1-7 set forth an illustrative example of the toy playset. Referring now to FIG. 1A, a toy playset 100 is presented having a coffin-shaped housing 102 with its contents initially hidden from the user. Housing 102 has five storage compartments 200, 300, 400, 500, and 600 that can be separately opened to reveal different toys and accessories. The doors of the storage compartments also have detachable hinges 104 that allow the doors to separate from the housing and decrease the likelihood of a door breaking and/or the housing being damaged in the event that the toy playset is accidentally dropped onto the ground. Compartments 200, 300, 400, 500, and 600 are all sized and shaped differently and are positioned such that they are all accessible from the front of housing 102. The back of housing 102 (not shown) contains holes that allow toy playset 100 to be hung on a wall. Further, the compartments of housing 102 are opaque so that their contents are a mystery to the user. However, in some embodiments, one or more of the compartments may have a fully or partially transparent section that allows a user to see its contents or be provided a hint as to its contents. In other embodiments, the housing may be another shape (e.g., cube, sphere, pyramid, egg, cone) or have a different number of compartments (e.g., 3, 4, 6 or more). Preferably, the housing has 3 or more compartments so that there can be a sequential unlocking and opening of the compartments (which will be discussed in further detail below). The individual compartments may also be any size or shape and be positioned at any location on the housing (e.g., front, back, top, bottom, sides). In additional or alternative embodiments, separate housings may contain one or more compartments that contain related accessories of the toy playset.

Figure 1B:
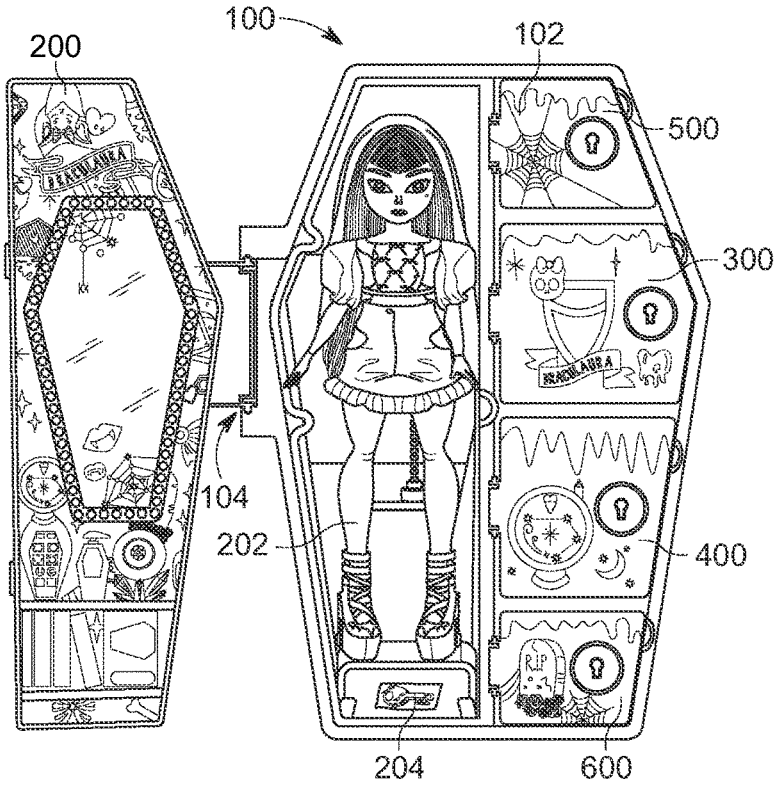

FIG. 1B shows housing 102 with its main compartment 200 opened to reveal a toy figurine 202. As will be further discussed herein, compartments 300, 400, 500, and 600 contain different accessories that can be attached to or played with toy figurine 202 and are smaller-sized compartments in comparison to main compartment 200. The larger size of main compartment 200 further has the effect of drawing a user towards opening it first. In other embodiments, the toys and accessories are distributed differently among the compartments. For example, the main toy (e.g., toy figurine) is not limited to being contained within the main compartment and may alternatively be contained inside a different (and resized) compartment. Consequently, the main compartment may be a different size or shape depending on its contents.

Furthermore, main compartment 200 is not lockable, whereas compartments 300, 400, 500, and 600 are lockable. Here, compartments 300, 400, 500, and 600 are initially locked, which results in main compartment 200 being opened first when a user first interacts with toy playset 100. In other embodiments, the main compartment is lockable but is initially in an unlocked configuration so that a user opens the main compartment first. The locks used in compartments 300, 400, 500, and 600 are simple pin-tumbler locks that each have an assigned key. Other types of key and lock mechanisms may also be used to fasten the lockable compartments (e.g., wafer tumbler lock, warded lock, tubular lock, lever tumbler lock). In one or more embodiments, each key is unique and can only be used to operate a corresponding lock for one of the compartments. In other embodiments, the keys can be used interchangeably to operate any of the locks. This allows a user to play with the toy playset even if one or more of the keys are lost or missing. Preferably, each key is still assigned to a different compartment even though the keys can be used interchangeably. Furthermore, the locks used in compartments 300, 400, 500, and 600 can also be unlocked without a key by twisting a protruding portion of the keyhole. This further ensures that the toy playset can still be played with even if all of the keys are missing.

Figure 1C:
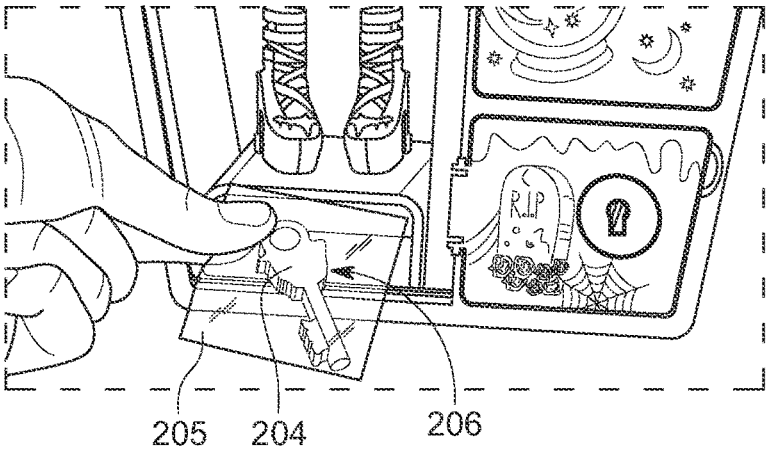

As shown in FIG. 1C, main compartment 200 contains a first key 204. First key 204 is assigned to unlock one of the locked compartments 300, 400, 500, and 600 and includes an identification feature that indicates the corresponding compartment that the key is assigned to unlock. Here, the identification feature is the color of the key, which matches the color of the corresponding compartment that the key unlocks. Other identification features can also be used to indicate the corresponding compartment that a key is assigned or configured to unlock. For example, the compartment may be identified by a specific symbol, shape, number, imagery, texture, and/or letter, and the identification feature of the key is a related or matching symbol, shape, number, imagery, texture, and/or letter.

Figure 2A:
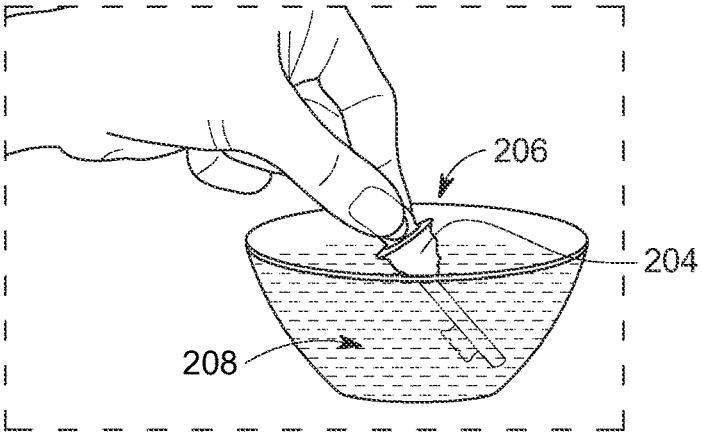
FIGS. 2A-2B illustrate the removal of a water-dissolvable outer layer from the key shown in FIG. 1C, in accordance with an embodiment of the invention.

However, as shown in FIGS. 1C and 2A, the true color of first key 204 (i.e., the identification feature of first key 204) is initially obscured by a removable outer layer 206 of a different color. Because the true color of the key indicates the corresponding compartment that it unlocks (i.e., the true color of the key matches the color of the corresponding compartment), a user is unable to determine the compartment that the key unlocks when the removable outer layer is disposed on the key. Only by removing the outer layer will the user be able to identify the correct compartment. First key 204 is further contained inside a transparent bag 205 which protects the outer layer 206 from being accidentally removed.

Preferably, the removable outer layer is formed from a material that dissolves when immersed in a fluid, such as water. For example, the removable outer layer may be a water-dissolvable layer of paint that is applied via any combination of spraying, brushing, dipping, etc. to form a thin, conformal film on the key. Unlike traditional paints, the water-dissolvable layer of paint may lack a cross-linker or curing agent so that the paint is easily dissolvable. For example, according to some embodiments, the removable outer layer may be a paint composed of approximately 40-60% water, approximately 15-22% organic solvent (e.g., ethanol), approximately 10-20% pigment/colorant, approximately 10-20% water soluble resin, approximately 0-3% film forming agent, approximately 0.5-3% dispersing agent, approximately humectant, and approximately 0-2% matting agent (e.g., silica). In at least some embodiments, the key can simply be dunked into a fluid to remove the dissolvable layer from the key but, in other embodiments, the key and/or the fluid may need to be agitated (e.g., by spinning the key) to remove the dissolvable layer from the key.

Figure 2B:
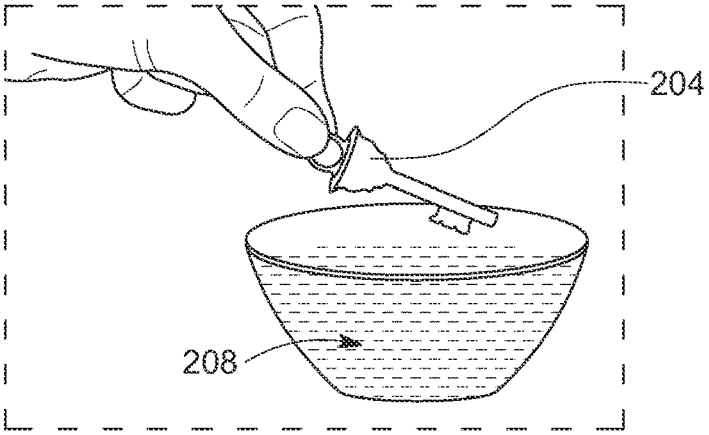

FIGS. 2A and 2B illustrate the removal of outer layer 206 from first key 204. FIG. 2A shows first key 204 being submerged (e.g., dunked) in a bowl of water 208. This causes outer layer 206 to dissolve and reveal the true color of first key 204 (see FIG. 2B). The dissolvable material that is used to form outer layer 206 is configured to decouple from first key 204 upon exposure to water 208 and mix into water 208. As shown in FIG. 2B, this causes water 208 to become colored and opaque and further hides first key 204 from view during its "transformation." Only after the user removes first key 204 from the colored water will the true color of first key 204 be revealed, resulting in an exciting surprise reveal. In some instances, removal of the dissolvable outer layer results in other changes to the fluid, such as causing the water to glitter. Other methods may also be used to obscure the identification feature, for example by placing the key in obscured packaging, slime, sand, etc.

Figure 3A:
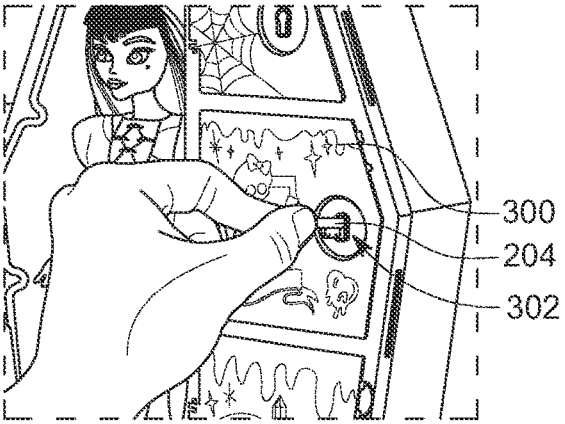
FIGS. 3A-3C illustrate the unlocking of a locked compartment with the key shown in FIG. 2B, in accordance with an embodiment of the invention.
Figure 3B:
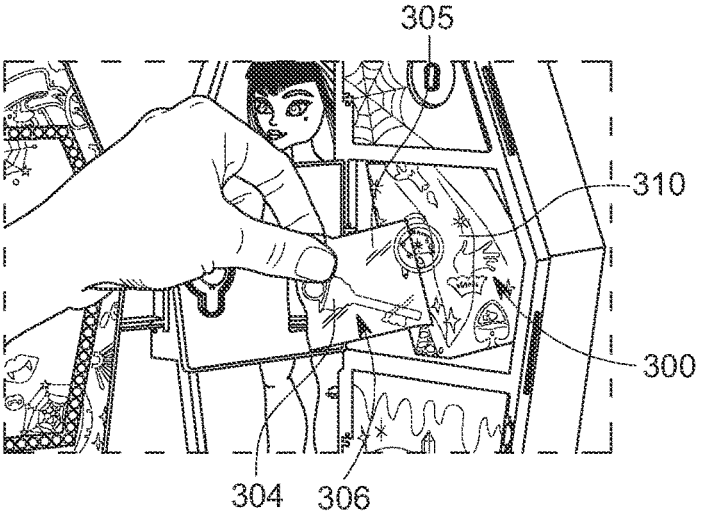
Figure 3C:
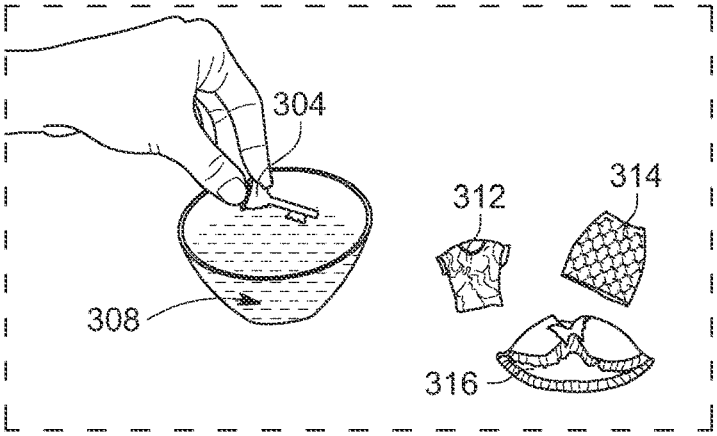

As shown in FIGS. 3A-3C, first key 204 can then be used to unlock lock 302 and open compartment 300, whose door is the same color as first key 204. Inside compartment 300 is a package 310 that contains various accessories that can be attached to or played with toy figurine 202, more specifically a shirt 312, a skirt 314, and a shawl 316. Package 310 is obscured to hide the identity of its contents, which provides yet another element of surprise when a user opens package 310 to discover the items contained within. Also included in compartment 300 is a second key 304 contained inside a transparent bag 305. Similar to first key 204, the true color of second key 304 (i.e., the identification feature of second key 304) is initially obscured by a removable outer layer 306 (see FIG. 3B), such as water-dissolvable paint. Removable outer layer 306 is the same color as the removable outer layer 206 initially covering first key 204 to further emphasize the unveiling of the true colors of the keys. Transparent bag 305 protects the outer layer 306 of second key 304 until it is ready to be removed. Submerging second key 304 in a bowl of water 308 causes removable outer layer 306 to dissolve and reveal the true color of second key 304 (see FIG. 3C). The true color of second key 304 matches the color of compartment 400 and thus indicates to the user that second key 304 can be used to unlock compartment 400. The removal of outer layer 306 also causes water 308 to become colored and opaque.

Figure 4A:
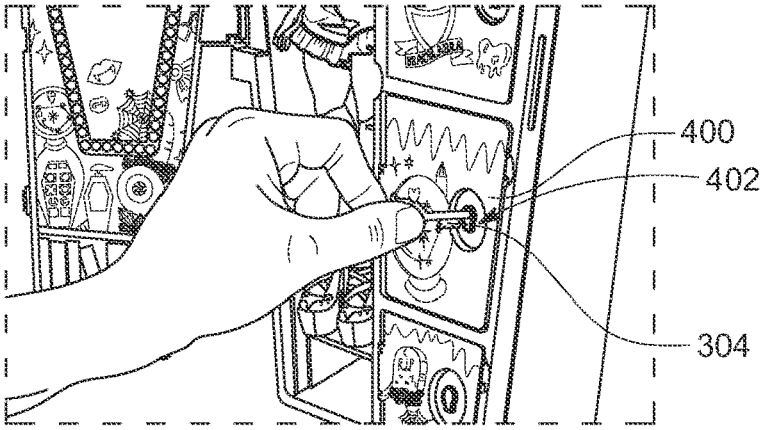
FIGS. 4A-4C illustrate the unlocking of a second locked compartment with the second key shown in FIG. 3C, in accordance with an embodiment of the invention.
Figure 4B:
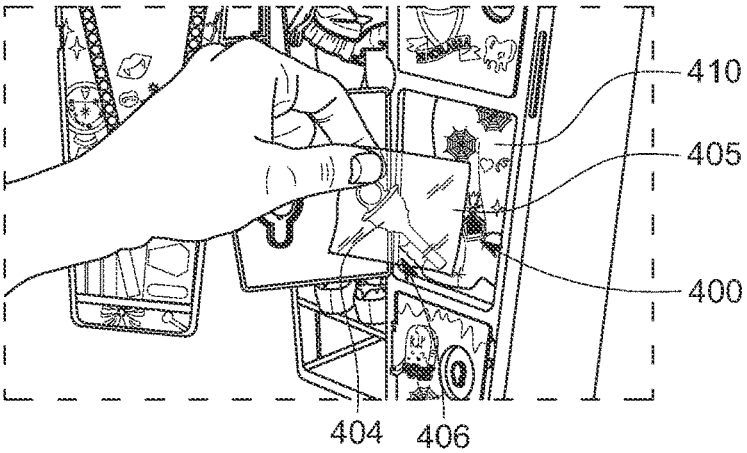
Figure 4C:
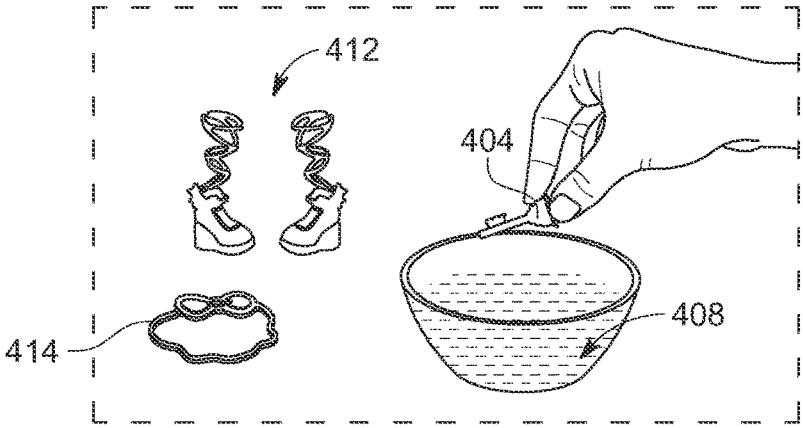

Referring now to FIGS. 4A-4C, a similar play pattern is repeated with the newly obtained second key 304. Second key 304 can be used to unlock lock 402 and open compartment 400. Inside compartment 400 is an obscured package 410 that contains shoes 412 and a keyring 414 for the keys included in toy playset 100. Also included in compartment 400 is a third key 404 contained inside a transparent bag 405. Similar to keys 204 and 304, the true color of third key 404 (i.e., the identification feature of third key 404) is initially obscured by a removable outer layer 406 (see FIG. 4B), such as water-dissolvable paint. Transparent bag 405 protects the outer layer 406 of third key 404 until it is ready to be removed. Submerging third key 404 in a bowl of water 408 causes removable outer layer 406 to dissolve and reveal the true color of third key 404 (see FIG. 4C). The true color of third key 404 matches the color of compartment 500 and thus indicates to the user that third key 404 can be used to unlock compartment 500. The removal of outer layer 406 also causes water 408 to become colored and opaque.

Figure 5A:
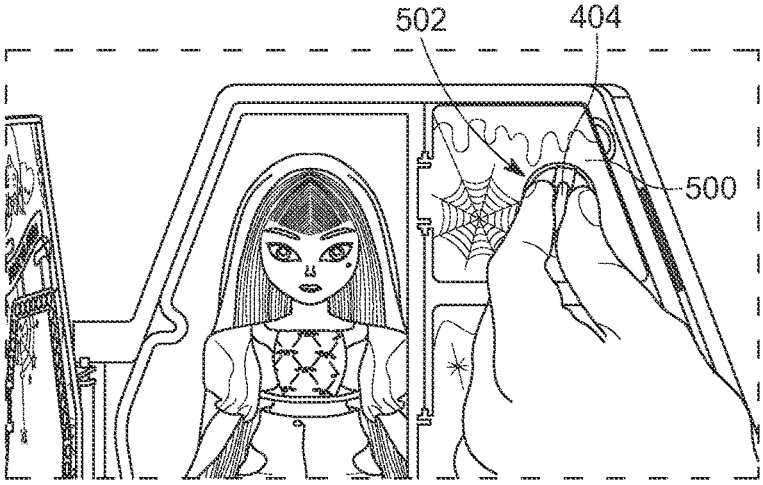
FIGS. 5A-5C illustrate the unlocking of a third locked compartment with the third key shown in FIG. 4C, in accordance with an embodiment of the invention.
Figure 5B:
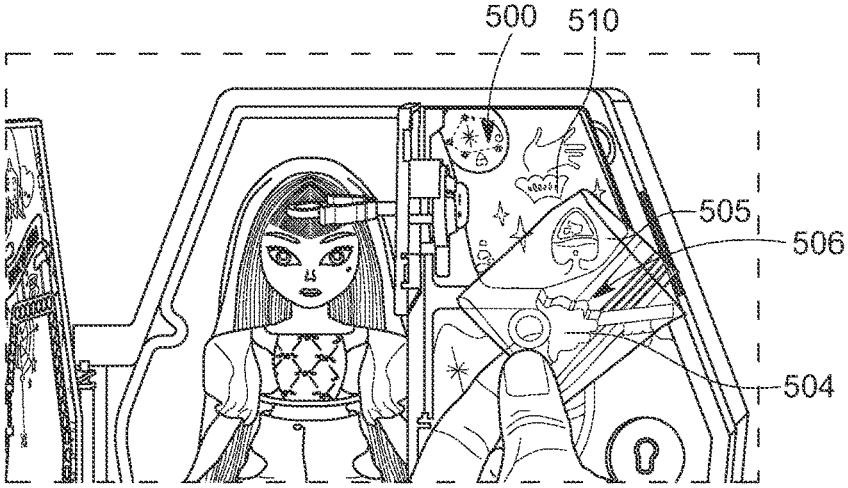
Figure 5C:
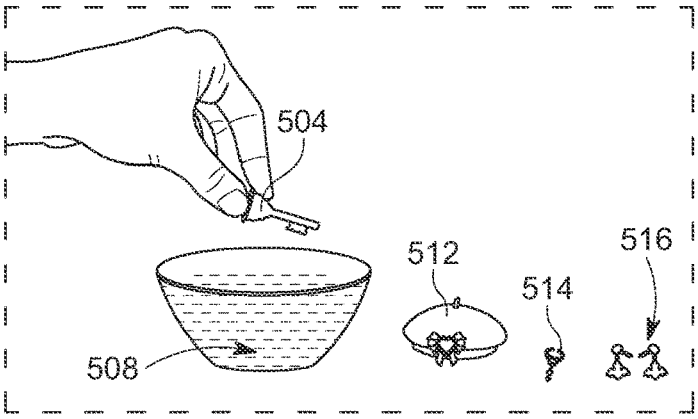

Referring now to FIGS. 5A-5C, a similar play pattern is repeated once again with the newly obtained third key 404. Third key 404 can be used to unlock lock 502 and open compartment 500. Inside compartment 500 is an obscured package 510 that contains a hat 512, a necklace 514, and earrings 516. Also included in compartment 500 is a fourth key 504 contained inside a transparent bag 505. Similar to keys 204, 304, and 404, the true color of fourth key 504 (i.e., the identification feature of fourth key 504) is initially obscured by a removable outer layer 506 (see FIG. 5B), such as water-dissolvable paint. Transparent bag 505 protects the outer layer 506 of fourth key 504 until it is ready to be removed. Submerging fourth key 504 in a bowl of water 508 causes removable outer layer 506 to dissolve and reveal the true color of fourth key 504 (see FIG. 5C). The true color of fourth key 504 matches the color of compartment 600 and thus indicates to the user that fourth key 504 can be used to unlock compartment 600. The removal of outer layer 506 also causes water 508 to become colored and opaque.

Figure 6A:
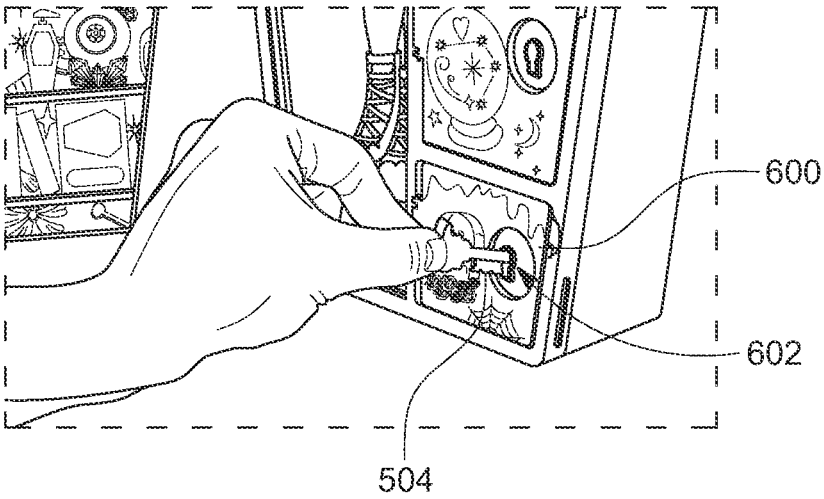
FIGS. 6A-6C illustrate the unlocking of a fourth locked compartment with the fourth key shown in FIG. 5C, in accordance with an embodiment of the invention.
Figure 6B:
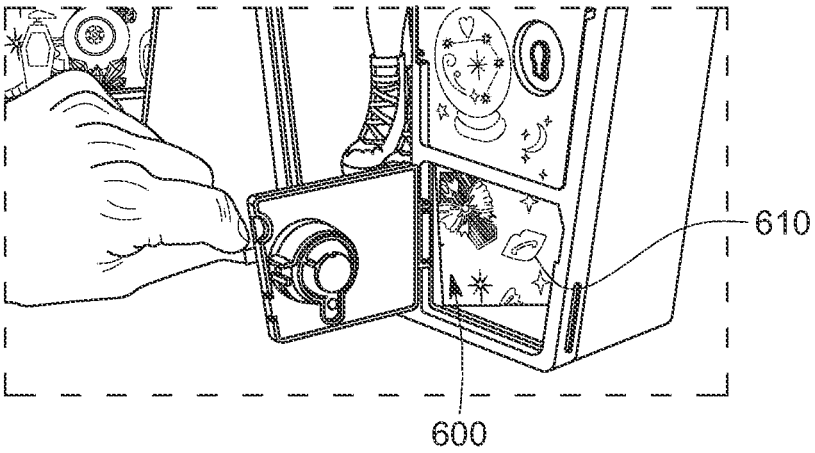
Figure 6C:
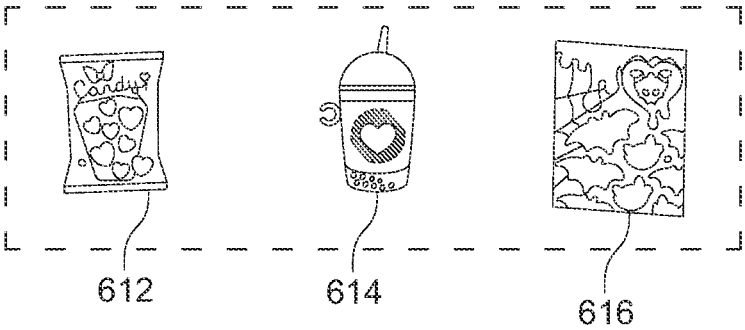

Finally, as shown in FIGS. 6A-6C, the process is repeated once again with fourth key 504. Fourth key 504 can be used to unlock lock 602 and open compartment 600. Inside compartment 600 is an obscured package 610 that contains a snack 612, a drink 614, and a notebook 616. Because this is the last compartment in the housing that can be unlocked, there is no additional key contained within. However, in at least one other embodiment, compartment 600 may contain an additional key that can be used to lock and unlock the main compartment 200.

Figure 7A:
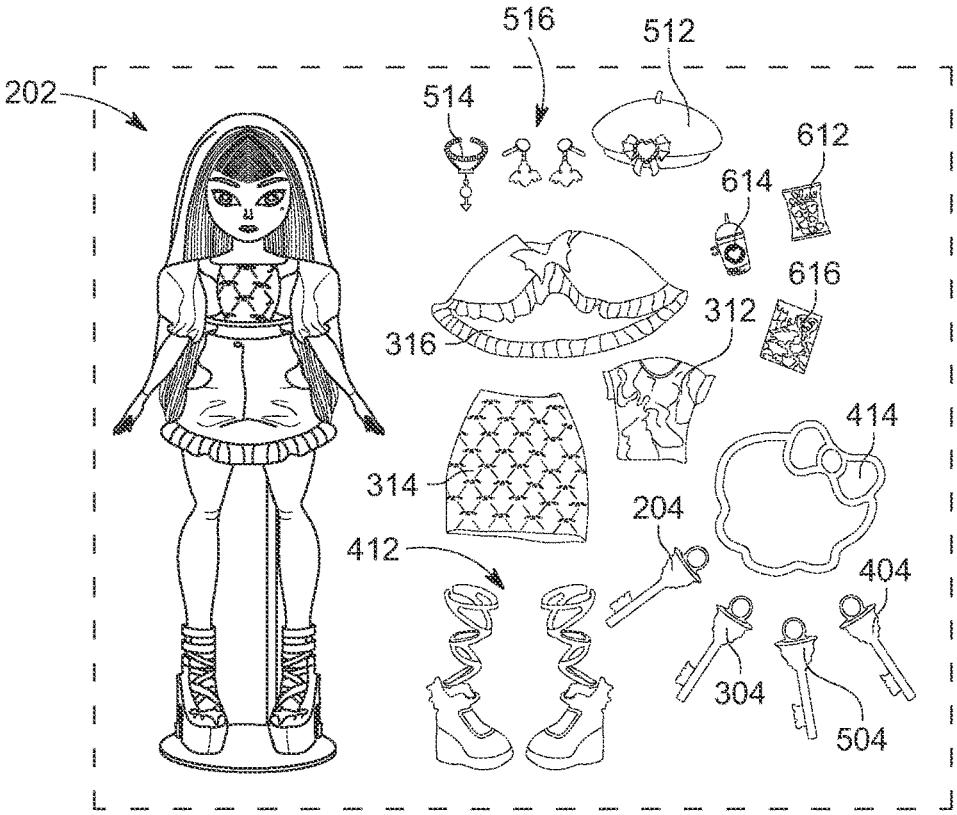
FIG. 7A shows the toy figurine and all the accessories contained within the toy playset, in accordance with an embodiment of the invention.
Figure 7B:
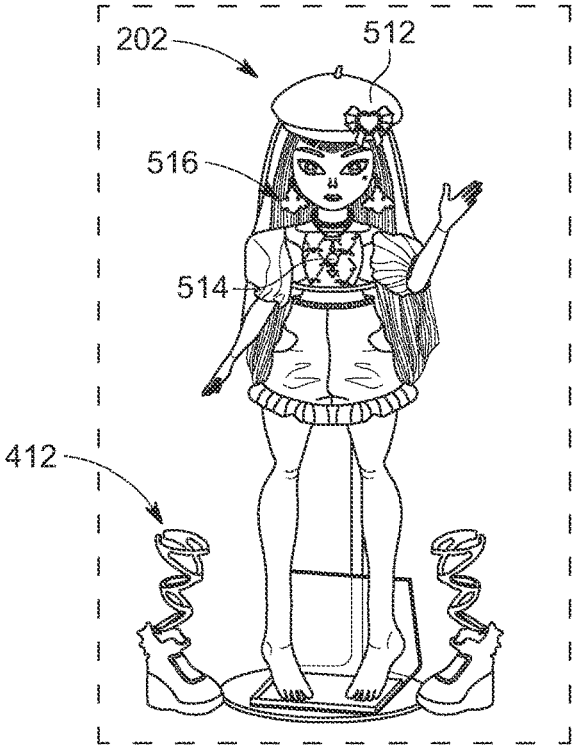
FIG. 7B illustrates a possible look that is achieved by attaching some of the accessories to the toy figurine.

FIG. 7A shows the toys and accessories that are obtained after unlocking and accessing all the compartments of toy playset 100. Many of the accessories can be worn or attached to toy figurine 202 in various arrangements to create different looks and fashions for toy figurine 202. FIG. 7B illustrates an outfit created using hat 512, necklace 514, earrings 516, and shoes 412. Not all of the accessories are attachable (for example keyring 414) but are generally related to the overall theme of toy playset 100. In other embodiments, all of the accessories contained in the toy playset can be worn or attached to the toy figurine. In further embodiments, the playset may include a different toy (e.g., positioned in the main compartment), such as a vehicle, a house, or a furniture piece, in addition to or as an alternative to the toy figurine. The accessories can be attached to or otherwise played in association with the toy. Further still, in certain embodiments, each compartment (e.g., including the main compartment) may include accessories that are associated with one another without a central or primary toy.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. For example, the keys may be distributed differently among the compartments. In one embodiment, all the keys are contained in the main compartment or multiple keys, which correspond to respective compartments or to the same compartment, are contained in one of the compartments other than the main compartment. A user thus obtains multiple (e.g., all) keys upon opening a single compartment (e.g., the main compartment), but would still need to remove the outer layer of each key to identify their corresponding compartments. The user would then be able to open the lockable compartments in any order using the keys. In another embodiment, the keys do not have a removable outer layer obscuring their identification feature. In yet another embodiment, a single key is provided that can unlock all of the lockable compartments.

Furthermore, it is to be understood that the toy figurine and packaging described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention. Finally, various features from one of the embodiments may be incorporated into another of the embodiments.

The invention claimed is:

1. A toy playset comprising:

a multi-compartment housing having a main compartment, a first locked compartment, and a second locked compartment;

a toy;

a first key assigned to unlock the first locked compartment; and a second key assigned to unlock the second locked compartment, wherein the first key and the second key both have an identification feature that indicates a corresponding compartment of the first locked compartment or the second locked compartment that can be unlocked by the first key or the second key, the first key and the second key both include a respective removable outer layer that obscures the identification feature of the first key and the second key, and the respective removable outer layer of the first key and of the second key are of a common color;

wherein the main compartment contains the toy and the first key, and the first locked compartment contains the second key.

2. The toy playset of claim 1, wherein the first locked compartment and the second locked compartment are identified by different colors, symbols, shapes, numbers, imagery, textures, and/or letters, and the identification feature is a matching color, symbol, shape, number, imagery, texture, and/or letter.

3. The toy playset of claim 2, wherein the first locked compartment and the second locked compartment are identified by different colors, and the identification feature is a matching key color.

4. The toy playset of claim 1, wherein the removable outer layer is a layer of water-dissolvable paint that lacks a cross-linker, a curing agent, or both.

5. The toy playset of claim 1, wherein at least one of the first locked compartment and the second locked compartment includes an accessory that can be attached to the toy, the accessory being packaged inside an obscured packaging.

6. The toy playset of claim 5, wherein:

the toy is a figurine; and the accessory is a hair accessory, clothing article or footwear that is configured to be worn by the figurine.

7. The toy playset of claim 1, wherein the multi-compartment housing further comprises:

a third locked compartment;

a third key assigned to unlock the third locked compartment;

a fourth locked compartment; and a fourth key assigned to unlock the fourth locked compartment;

wherein the second locked compartment contains the third key, and the third locked compartment contains the fourth key.

8. The toy playset of claim 1, comprising a third locked compartment, wherein the first key, the second key, or both are assigned to interchangeably unlock the third locked compartment.

9. The toy playset of claim 8, comprising a third key contained in the third locked compartment, wherein the third key is configured to interchangeably unlock the first locked compartment and the second locked compartment.

10. The toy playset of claim 1, wherein the first locked compartment, the second locked compartment, or both comprise a keyhole configured to receive a corresponding key of the first key or the second key for unlocking, and the keyhole is configured to twist for unlocking without receipt of the corresponding key.

11. A toy playset comprising:

a multi-compartment housing having a main compartment and a plurality of lockable compartments;

a toy; and a plurality of keys, wherein each key is assigned to unlock one of the plurality of lockable compartments, each key of the plurality of keys has an identification feature that indicates the assigned lockable compartment that can be unlocked, each key of the plurality of keys includes a removable outer layer that obscures the identification feature, and the removable outer layer of each key is the same color;

wherein the main compartment contains the toy and one of the plurality of keys, and each of the plurality of lockable compartments contains one or none of the plurality of keys.

12. The toy playset of claim 11, wherein each lockable compartment of the plurality of lockable compartments is identified by a different color, symbol, shape, number, imagery, texture, and/or letter, and the identification feature is a matching color, symbol, shape, number, imagery, texture, and/or letter.

13. The toy playset of claim 12, wherein each lockable compartment of the plurality of lockable compartments is identified by a different color, and the identification feature is a matching key color.

14. The toy playset of claim 11, wherein the removable outer layer is a layer of water-dissolvable paint that lacks a cross-linker, a curing agent or both.

15. The toy playset of claim 11, wherein at least one of the plurality of lockable compartments includes an accessory that can be attached to the toy.

16. The toy playset of claim 15, wherein:

the toy is a figurine; and the accessory is a hair accessory, clothing article, or footwear that is configured to be worn by the figurine.

17. The toy playset of claim 11, wherein the main compartment is not lockable by any of the plurality of keys.

18. A toy playset comprising:

a multi-compartment housing having a plurality of compartments, wherein at least one compartment of the plurality of compartments is lockable;

a toy contained inside one of the plurality of compartments; and one or more keys, each key configured to unlock a corresponding compartment of the plurality of compartments;

wherein each key has an identification feature that indicates the corresponding compartment that can be unlocked and a removable outer layer that obscures the identification feature, and a color of the removable outer layer of each key is the same.

19. The toy playset of claim 18, wherein each compartment of the plurality of compartments is identified by a different color, symbol, shape, number, imagery, texture, and/or letter, and the identification feature is a matching color, symbol, shape, number, imagery, texture, and/or letter.

20. The toy playset of claim 18, wherein the removable outer layer is a layer of water-dissolvable paint that lacks a cross-linker, a curing agent or both.

* * * * *